US006439409B1

(12) United States Patent
Dressel et al.

(10) Patent No.: US 6,439,409 B1
(45) Date of Patent: Aug. 27, 2002

(54) CHILD-RESISTANT AND ELDER-FRIENDLY VIAL CLOSURE SYSTEM

(76) Inventors: Mark W. Dressel, 340 Waterford Dr., Lake Zurich, IL (US) 60047; John M. Bitner, 1001 Forest Trail, Sugar Grove, IL (US) 60554

( * ) Notice: Subject to any disclaimer, the term of this patent is extended or adjusted under 35 U.S.C. 154(b) by 0 days.

(21) Appl. No.: 09/754,685

(22) Filed: Jan. 3, 2001

(51) Int. Cl.[7] ..... B65D 50/08

(52) U.S. Cl. ..... 215/228; 215/209; 215/216; 215/225

(58) Field of Search ..... 215/209, 213, 215/214, 216, 224, 225, 228, 245, 317, 321; 220/326, 281

(56) References Cited

U.S. PATENT DOCUMENTS 3,642,161 A * 2/1972 Stroud ..... 215/213
3,703,975 A * 11/1972 Wittemer ..... 215/213
3,790,015 A * 2/1974 Imamura ..... 215/209
4,480,762 A * 11/1984 Thomas ..... 215/216
4,613,051 A * 9/1986 Swartzbaugh ..... 215/225
5,449,077 A * 9/1995 Seidler ..... 215/216
5,860,543 A * 1/1999 Decelles ..... 215/209
6,039,196 A * 3/2000 Ekkert et al. ..... 215/216
6,161,711 A * 12/2000 Miceli et al. ..... 215/224

* cited by examiner

*Primary Examiner*—Nathan J. Newhouse
(74) *Attorney, Agent, or Firm*—Bullwinkel Partners, Ltd.

(57) ABSTRACT

A child-resistant and elder-friendly vial/cap system in which a locking ledge located on either the vial or the cap is engaged by a latch located on the other of the vial or the cap. The latch is located on one end of a lever and a pressure tab is located on the other end. A fulcrum is located between the latch and the pressure tab. Pressing in an inward radial direction on the pressure tabs disengages the latch from the locking ledge and allows the cap to be removed from the vial. The cap has a plug on its opposite end so that it may be readily reversed make the cap easily removable when the child-resistant feature is not needed.

6 Claims, 5 Drawing Sheets

CHILD-RESISTANT AND ELDER-FRIENDLY VIAL CLOSURE SYSTEM

CROSS-REFERENCE TO RELATED APPLICATIONS:

(Not Applicable)

BACKGROUND OF THE INVENTION

1. Field of the Invention

This invention relates to closures or caps for vials or bottles, and more particularly to a combination vial and cap that is both child-resistant and elder-friendly.

2. Description of the Related Art

Child-resistant bottles and caps are known generally in the art. Most of these involve screw-type caps in which a separate motion, such as a downward axial movement, to disengage the locking mechanism, followed by rotation. Others require a radial inward (squeezing) motion, followed by rotation. Some of these prior art designs are shown by the following patents:

U.S. Pat. No. 6,085,920 (Moretti, issued Jul. 11, 2000) describes a child-resistant closure for bottles with easier operation. The child-resistant closure comprises a metal cap connected to a hood and an outer cap which engages the hood to prevent accidental removal.

U.S. Pat. No. 5,918,752 (Meyer, issued Jul. 6, 1999) describes a tamper-evident squeeze-and-turn child-resistant closure.

U.S. Pat. No. 5,588,545 (King, issued Dec. 31, 1996) describes another child-resistant and elderly friendly closure for containers. The closure comprises an inner part and an outer part, each having castellations which lock when the outer part is displaced axially.

U.S. Pat. No. 5,040,694 (Gambello, issued Aug. 20, 1991) describes a child-resistant cap comprising a lower cap and an upper cap. The lower cap and the upper cap must be aligned in a certain way to remove the cap from the container.

U.S. Pat. No. 4,954,459 (DeJonge, issued Aug. 8, 1991) describes another vial and closure design which may be rendered non-child-resistant. Downward pressure is required to engage ratchet type segments to permit removal of the cap.

U.S. Pat. No. 4,034,882, (Wright, Jul. 12, 1999) describes a bottle closure having a raised helical thread. Rotation of the closure followed by pushing in a downward direction is required to remove the closure from the bottle.

However, these devices, while achieving the objective of making the closure child-resistant, still tend to be difficult for seniors, those with arthritis, or individuals with other hand debilitations, to manipulate and open.

SUMMARY OF THE INVENTION

The present invention is a combination vial/cap or bottle/cap system in which the closure is both child-resistant and elder-friendly. The cap is removable from the vial or bottle.

Because the physical elements of the vial and closure of the present invention have sidewalls parallel to their vertical axis, without protrusions which break the vertical plane, these elements are particularly adapted for efficient and effective use with high speed automatic filling and capping equipment.

In the preferred embodiment of the invention, a locking ledge is located on the vial and two levers are located on the cap. A latch on one end of each lever engages the locking ledge to lock the cap onto the vial. A pressure tab is located at the other end of each lever. Two fulcra are located on each lever between the pressure tab and latch. Pressing. both pressure tabs simultaneously in a radial inward direction unlocks the cap from the vial by releasing the latch from the locking ledge. The cap may then be removed from the vial by simply lifting it off in an axial (vertical) direction, with no other coordinated motion being required.

In this preferred embodiment of the invention, the cap can also be flipped over and secured to the vial with a plug seal located on the opposite side of the cap. In this orientation, the cap is easily removed even by a person with limited strength and dexterity, although it is not child-resistant.

In a second embodiment of the invention, two locking ledges are located on a snap-cap and two levers are located on the collar of the vial. Each lever has a pressure tab at one end and a latch on the other end. Pressing both pressure tabs simultaneously in an radial inward direction unlocks the cap from the vial by releasing the latch from the locking ledge. The cap can then be lifted off the vial in an axial (vertical) direction.

In this second embodiment of the invention, the cap can also be flipped over and locked to the vial via the latches in a fashion that can be more easily removed. The direction of the taper on the locking ledge on the cap when the cap is flipped over allows the cap to be more easily removed. In this orientation, the vial and cap combination is not child resistant.

In either embodiment, even in the child-resistant orientation, because there is no orientation of the cap or the vial, or turning needed, the cap is easier to manipulate for senior adults who may suffer from arthritis, or other individuals with hand debilitations, or with difficulty manipulating small items. However, because both pressure tabs must be pressed simultaneously while pulling or lifting the cap in an axial direction, the cap is difficult for children to manipulate.

Thus, it is a principal object of this invention to provide a vial and cap system which is both child-resistant and elder-friendly.

It is also an object of this invention to provide a vial and cap system in which, with the cap in one orientation, the cap is child-resistant, and with the cap in a flipped-over orientation, the child-resistant feature may be temporarily disabled.

It is also an object of this invention to provide a vial and cap system in which the locking mechanism can be located on either the cap or on the vial.

It is also an object of this invention to provide a vial and cap combination in which no rotation, orientation, alignment, torque, downward force or inordinate amount of manual pressure is required to remove the cap from the vial.

It is a further object of the invention to provide a design in which the physical elements of the vial and closure have sidewalls parallel to their vertical axis, without protrusions which break the vertical plane, simplifying their manufacture and making them particularly adapted for efficient and effective use with high speed automatic bottling and capping equipment.

THE DRAWINGS

FIG. 1 is a side elevation view in cross-section of the preferred embodiment of the cap of the present invention joined with a vial;

FIG. 1*a* is an enlarged fragmentary cross-section of the edge of the cap of FIG. 1 showing the sealing edge of the cap about to engage the corresponding edge of the vial;

FIG. 1*b* is an enlarged fragmentary cross-section similar to FIG. 1*a* showing the cap in sealing engagement with a vial;

DETAILED DESCRIPTION OF THE INVENTION

A First (Preferred) Embodiment

The Cap In Child-Resistant Orientation

Figure 1:
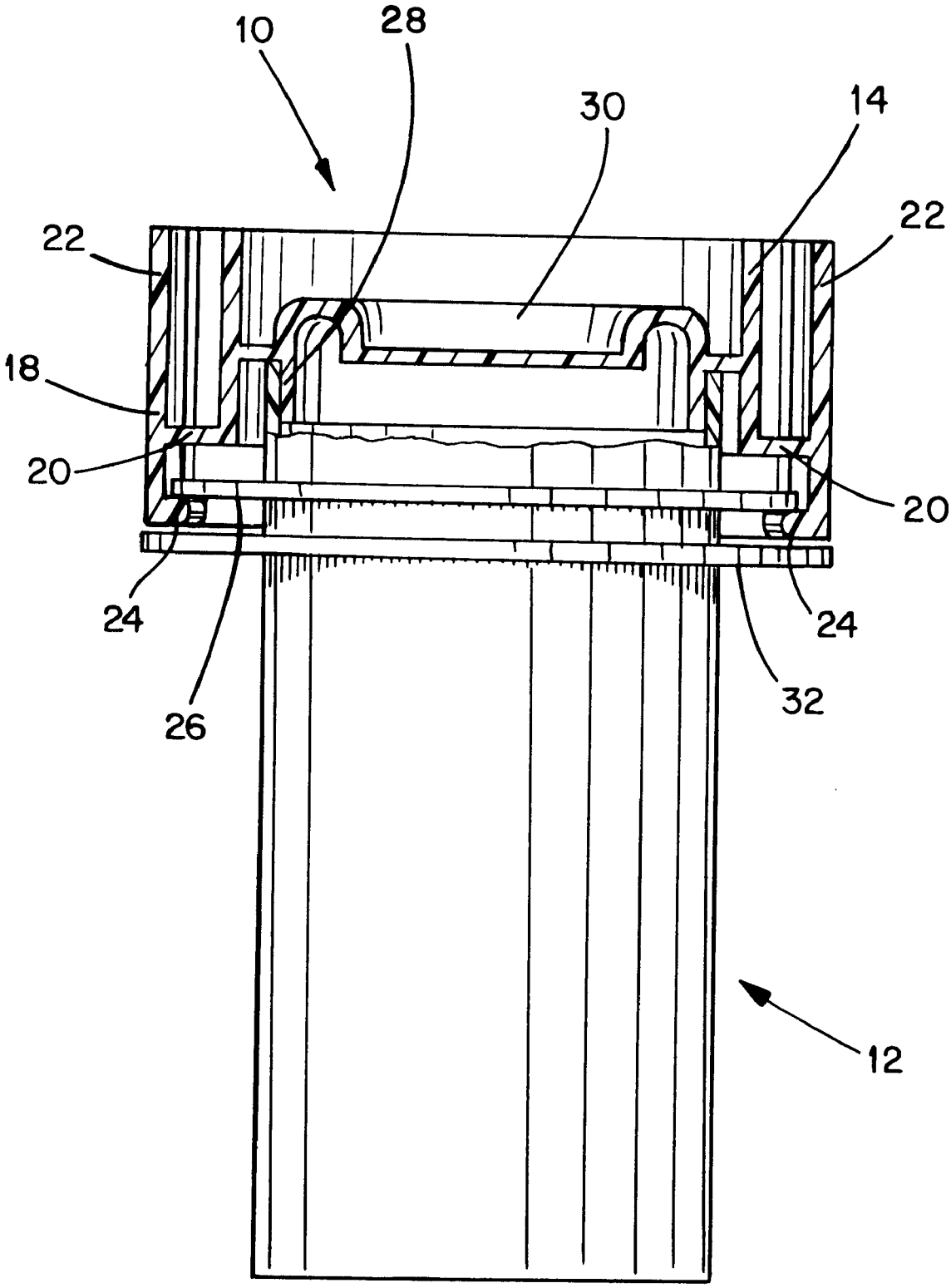
Figure 1A:
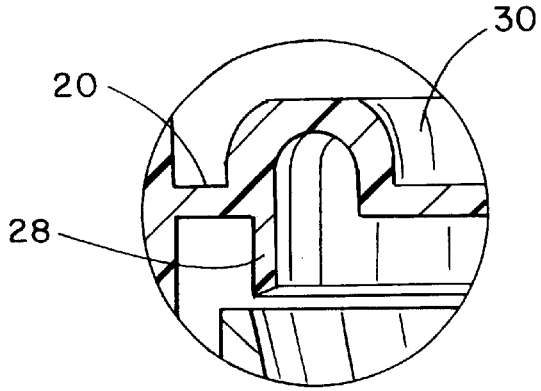
Figure 1B:
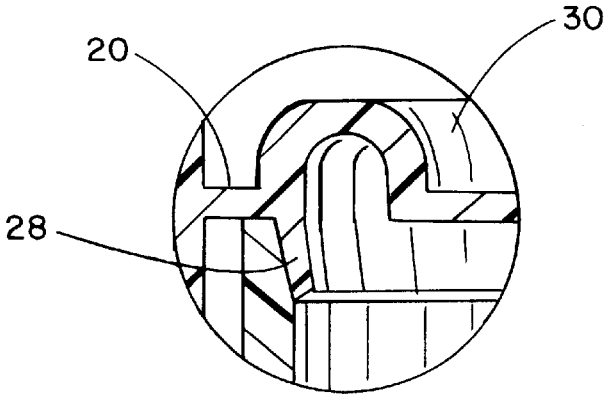
Figure 6:
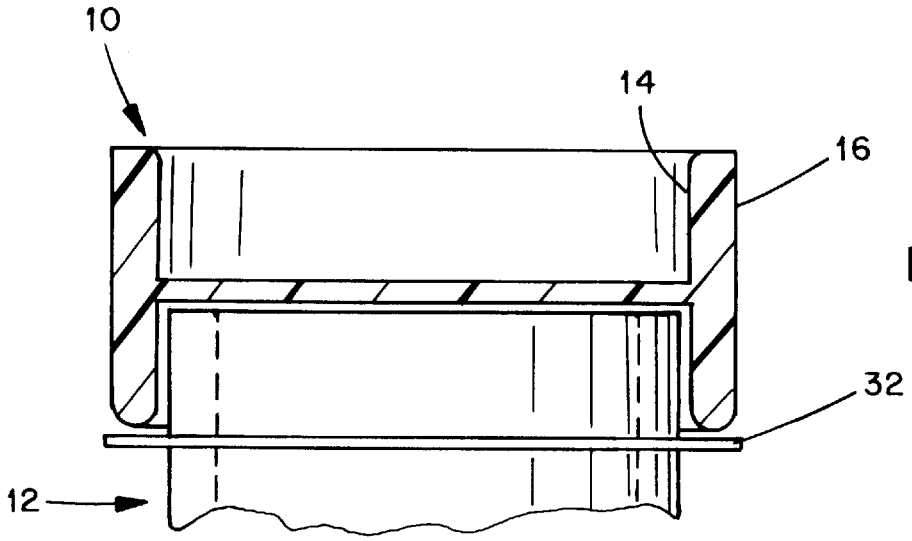
FIG. 6 is a partially cut-away side elevation of the preferred embodiment of the vial and cap of the present invention showing the location of the secondary ridge on the vial below the cap. The locking ledge on the vial and the levers on the cap are not shown.
Figure 7:
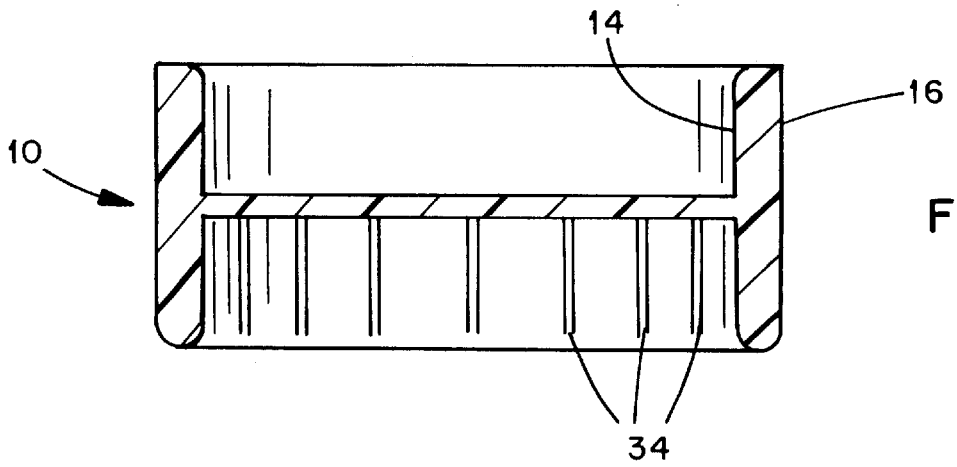
FIG. 7 is a partially cut-away side elevation of the preferred embodiment of the cap of the present invention showing the internal vertical ribs on the inside of the cap. The levers on the cap are not shown.
Figure 8:
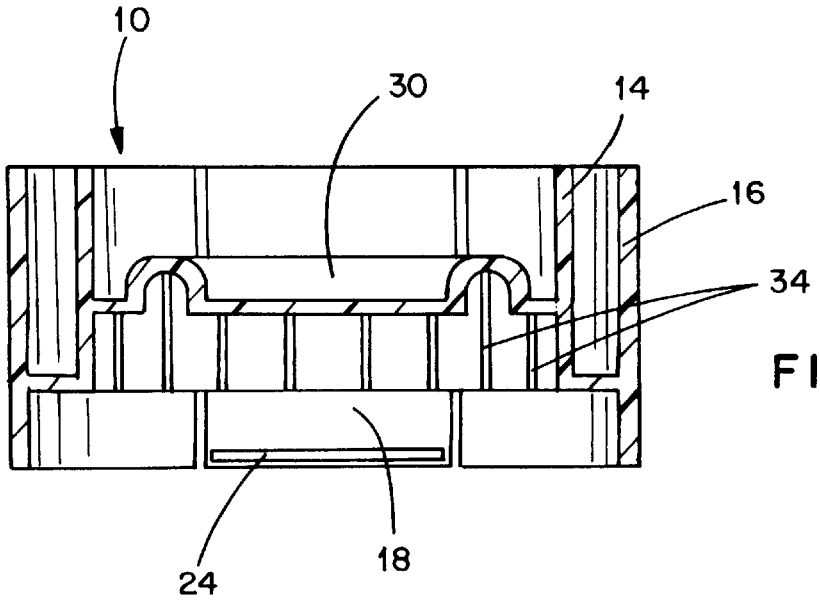
FIG. 8 is a partially cut-away side elevation of the preferred embodiment of the cap of the present invention showing the tapered plug, and one lever and latch.

Turning to the drawings, FIGS. 1–8 show the preferred embodiment of the present invention. FIG. 1 shows a cap 10 attached to a vial 12. The cap 10 and vial 12 have a common central axis. The cap 10 is generally circular in shape and has an inner wall 14 and an outer wall 16. The outer wall is best shown in FIG. 8. Integral with the outer wall 16 are preferably two side panels, or levers 18 spaced preferably 180 degrees apart. Preferably two fulcra 20 connect each lever 18 to the inner wall 14. The lever 18 terminates in a pressure tab or region 22 for applying manual pressure to release the cap 10 from the vial 12. At the other end of the lever 18 is a latching ridge 24.

Figure 5:
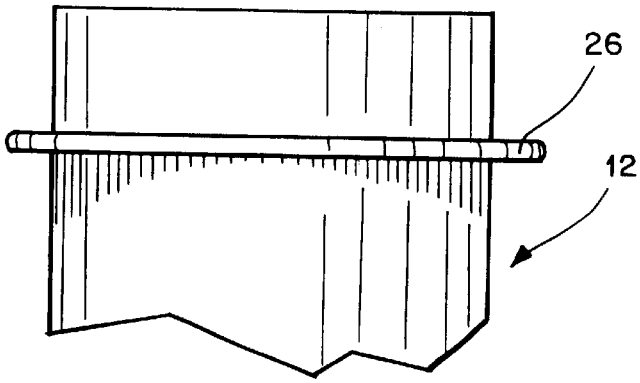
FIG. 5 is a side view of the vial of the preferred embodiment of the invention showing the location of the locking ledge.

As best shown in FIGS. 1 and 5, the vial 12 has a circumfrential locking ledge 26. The locking ledge 26 is a peripheral extension of the vial 12, and is substantially perpendicular to the central axis of the vial 12 and the cap 10.

The vial is preferably made of a tough, flexible and resilient material such as high density polyethylene (HDPE) or polypropylene. The cap is preferably made of polypropylene or a similar modified polymer.

The cap 10 has a first sealing surface 28 for securing the cap 10 to the vial 12 via the latches 24, and a second sealing surface 30 which preferably is a tapered plug on the opposite side of the cap 10 for securing the cap 10 to the vial 12 by frictional engagement. The cap 10 can be pushed onto the vial 12 to engage and retain the vial 12 in a push-on sealing relationship with either the first sealing surface 28 or the tapered plug 30.

As shown in FIG. 1, when the vial 12 and cap 10 are in the locked position, the latch 24 is engaged with the locking ledge 26 and prevents removal of the cap 10 from the vial 12 when the cap 10 is pulled in the axial direction.

Figure 2:
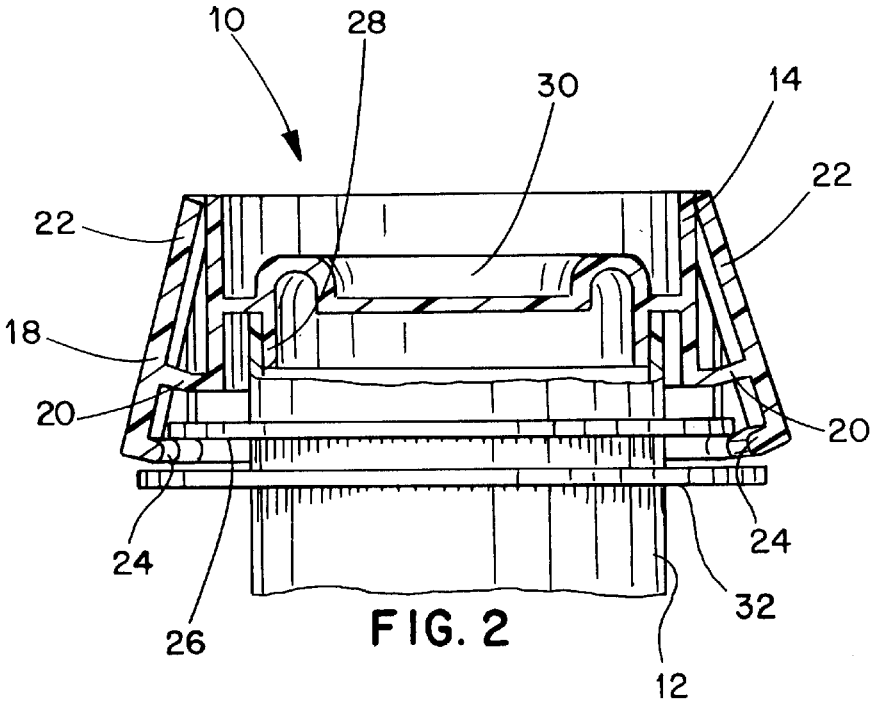
FIG. 2 is a cross section showing the cap being disengaged by grasping the cap and applying finger pressure to rotate the locking lugs about their fulcra into released position.

As shown in FIG. 2, when the pressure tabs 22 are pressed simultaneously using, for example, a thumb and forefinger in an inward radial direction, the levers 18 pivot on the fulcra 20, and the latches 24 are caused to move in an outward radial direction away from the locking ledge 26. Once the latches 24 are disengaged from the locking ledge 26, the cap 10 can then be removed from the vial 12 by lifting upwards in an axial direction.

Figure 3:
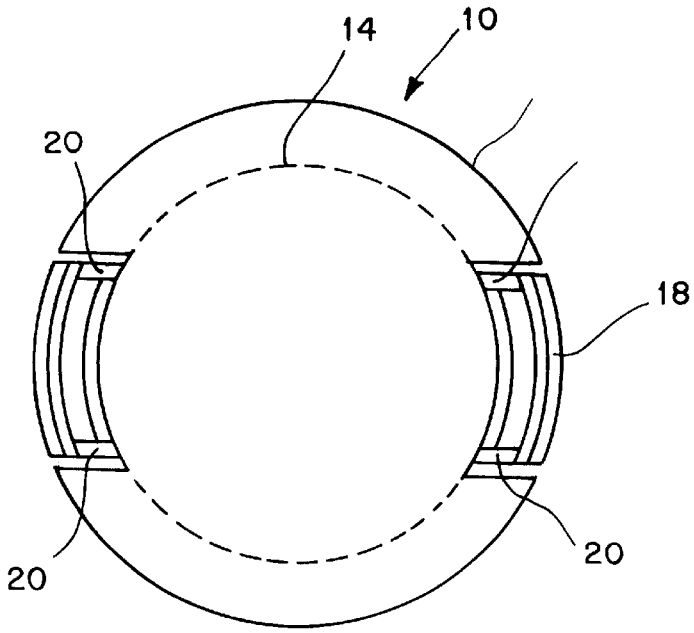
FIG. 3 is a top view of cap of the preferred embodiment of the present invention showing the locations of the levers and the fulcra (the dashed line represents the inner wall of the cap)
Figure 4:
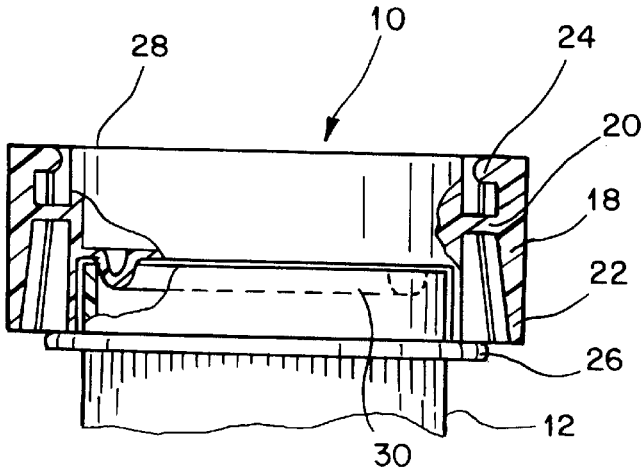
FIG. 4 is side elevation view in cross section similar to FIG. 2 showing the cap of the present invention intentionally attached in inverted position to avoid engaging the locking lugs, when the child-resistant feature of the invention is not required.

FIG. 3 shows the top view of the cap 10 showing the levers 18 integral with the outer wall 16 as well as the location of the two fulcra 20 attached to each lever 18. FIG. 5 shows the location of the locking ledge 26 around the circumference of the vial 12.

As shown in FIG. 6, the vial 12 preferably has a secondary ridge 32 below and parallel to the locking ledge 26. (The locking ledge on the vial and the levers on the cap are not shown.) The secondary ridge 32 prevents access to the cap 10 from underneath and makes it difficult for a child to pry off the cap 10 with either fingers or teeth. Optimally, the clearance between the secondary ridge 32 and the bottom of the cap 10 should be as small as practical.

As shown in FIG. 7, the cap 10 also preferably has internal vertical ribs 34 on the inside of the cap 10. (The levers on the cap are not shown.) The internal vertical ribs 34 require that a vertical lift be used to remove the cap 10 from the vial 12. The internal vertical ribs 34 also provide a snug fit of the cap 10 to the vial 12. Preferably, the clearance between the outer surface of the vial 12 and the internal vertical ribs 34 should be as tight as is functionally feasible.

The Cap In Non-Child-Resistant Orientation

The cap 10 is reversible, i.e., it can be flipped over and used as a cap in the opposite orientation. FIG. 5 shows the cap 10 in the inverted non-child-resistant position. The tapered plug 30 is adapted to be received and retained by the opening in the vial 12 by frictional engagement.

A Second Embodiment

The Cap In Child-Resistant Orientation

Figure 9:
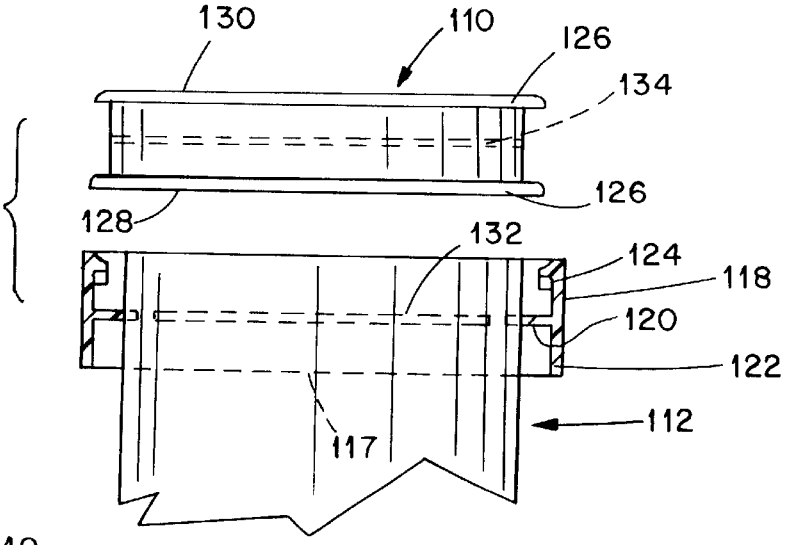
FIG. 9 is an exploded view of the second embodiment of the vial and cap of the present invention showing the cap separated from the vial.
Figure 10:
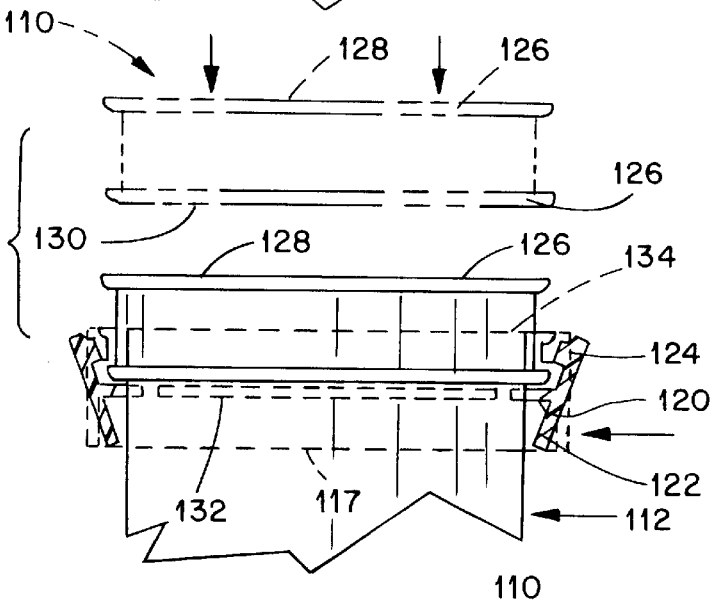
FIG. 10 is an exploded view of the second embodiment of the vial and cap of the present invention showing the pressure tabs pushed in an inward radial direction and the latches released from the locking ledge.
Figure 11:
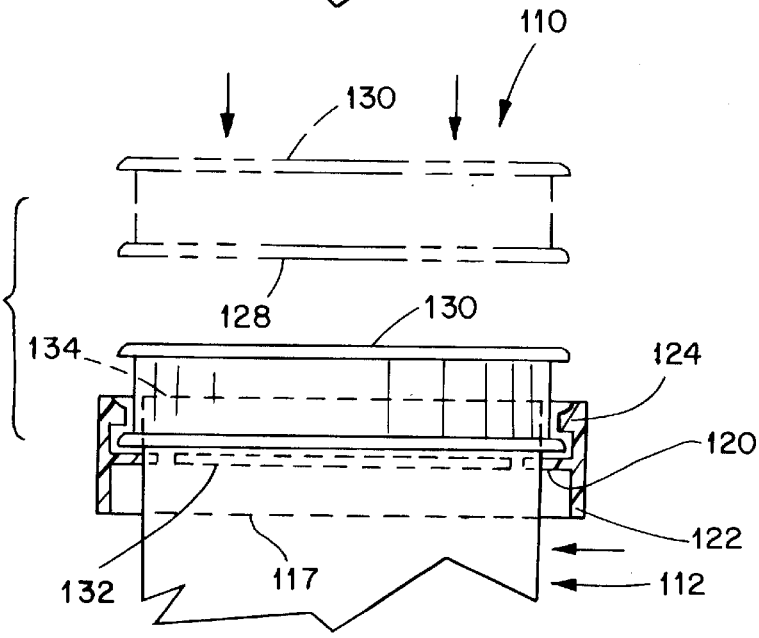
FIG. 11 is an exploded view of the second embodiment of the vial and cap of the present invention showing the cap in the inverted non-child-resistant orientation and also showing how the taper of the locking ledge secured by the latch will allow for easier removal of the cap.

FIGS. 9–11 show a second embodiment of the vial and cap of the present invention. In this second embodiment, at least one locking ledge is located on the cap, while two levers are located on the vial.

FIG. 9 shows a cap 110 and a vial 112. The cap 110 and the vial 112 have a common central axis. The cap 110 is a snap-on type cap and is generally circular in shape and has two locking ledges 126, one at the top 128 and one at the bottom 130 of the circumference of cap 110. Each locking ledge 126 is a peripheral extension of the cap 110 and is substantially perpendicular to the central axis of the cap 110 and the vial 112.

The outer edges of each locking ledge 126 are tapered. The locking ledge 126 around the circumference around the top 128 of the cap 110 is tapered in the same direction as taper of the locking ledge 126 around the circumference around the bottom 130 of the cap 110.

Around the top of the vial 112 is a collar 117. Integral with the collar 117 are preferably two side panels or levers 118 spaced preferably 180 degrees apart around the circumference of the vial 112. Preferably two fulcra 120 connect each lever 118 to the vial 112. At one end of each lever 118 is a pressure tab 122. At the other end of each lever 118 is a latch 124.

As with the first embodiment, the vial is preferably made of a tough, flexible and resilient material such as high density polyethylene (HDPE) or polypropylene, and the cap is preferably made of polypropylene or a similar modified polymer.

When the vial 112 and cap 110 are in the locked position, the latch 124 is engaged with the locking ledge 126 and prevents removal of the cap 110 from the vial 112 when the cap 110 is pulled in the axial direction. As shown in FIG. 10, when the pressure tabs 122 are moved simultaneously using a thumb and finger in an inward radial direction the levers 118 pivot on the fulcra 120, and latches 124 are caused to move in an outward radial direction away from the locking ledge 126. Once the latches 124 are disengaged from the locking ledge 126, the cap 110 can then be removed from the vial 112 by lifting upwards in an axial (vertical) direction.

Preferably, the vial additionally has a secondary ridge 132 under the collar 117 and in alignment with the fulcra 120. The secondary ridge 132 prevents access to the cap 110 from underneath and makes it difficult for a child to pry off the cap 110 with either fingers or teeth. Optimally, the clearance between the secondary ridge 132 and the bottom of the cap 110 should be as small as is functionally feasible.

The cap 110 has a mid-point 134. At the mid-point is a solid plane of material which forms the top of the cap in either orientation. As shown in FIG. 10, when the cap 110 is connected to the vial 112, the mid-point 134 is in alignment with the top of the vial.

The Cap In Non-Child-Resistant Orientation

The cap 110 is reversible, i.e., it can be flipped over and used as a non-child-resistant cap in the opposite orientation. FIG. 11 shows the cap 110 in the inverted non-child-resistant position. As shown in FIG. 11, when the cap 110 is flipped over and used as non-child-resistant cap, the direction of the taper of the locking ledge 126 around the top 128 of the cap locked by the latches 124 allows the cap to be more easily removed from under the latches 124 when the vial 112 and cap 110 combination is in the locked position.

Also in this second embodiment, as shown in FIG. 11, when the cap 110 is connected to the vial 112, the mid-point 134 is in alignment with the top of the vial.

Other embodiments of the invention are contemplated which do not depart from the scope of the invention claimed. While the preferred form of the invention has been shown and described herein, it is to be understood that the invention is not to be taken as limited to the specific form described herein, and that changes and modifications may be made without departing from the true concept of the invention. It is therefore contemplated that the foregoing teachings and the appended claims define the present invention and any and all changes and modifications.

We claim as our invention:

1. A child-resistant and elder-friendly vial and removable cap, the cap and vial having a common central axis, comprising, in combination:

a.) said vial having a peripherally extending primary locking ledge substantially perpendicular to the central axis;

b.) said cap having at least one lever, said lever having at one end a latch engageable with said primary locking ledge to secure the cap against removal from said vial, a pressure tab at the lever's opposite end, and at least one fulcrum intermediate the latch and pressure tab, whereby movement of the pressure tab in an inward radial direction causes movement of the latch in an outward radial direction away from the locking ledge;

c.) said lever and said fulcrum being formed of flexible and resilient material integral with said cap, whereby the latch may be disengaged by manually applying pressure radially inward, and then pulling the cap in an axial direction away from the vial; and d.) said cap has a first sealing surface adapted to be secured by the latch and a second scaling surface on its opposite side comprising a tapered plug which is adapted to be received and retained by the interior surface of said vial in frictional engagement.

2. The improvement of claim 1 further comprising a peripherally extending secondary ledge below and substantially parallel to said primary locking ledge.

3. The improvement of claim 1 wherein said cap further comprises internal vertical ribs.

4. The improvement of claim 1 in which the cap is reversible.

5. A child-resistant and elder-friendly vial and removable cap, the cap and vial having a common central axis, comprising, in combination.

a.) said cap having a-peripherally extending primary locking ledge substantially perpendicular to the central axis on one side and a peripherally extending secondary locking ledge substantially perpendicular to the central axis on the opposite side, said secondary locking ledge having at least one side of the protruding portion inwardly tapered;

b.) said vial having at least one lever, said lever having at one end a latch engageable with said primary locking ledge to secure the cap against removal from said vial, a pressure tab at the lever's opposite end, and at least one fulcrum intermediate the latch and pressure tab, whereby movement of the pressure tab in an inward radial direction causes movement of the latch in an outward radial direction away from the locking ledge;

c.) said lever and said fulcrum being formed of flexible and resilient material integral with said vial, whereby the latch may be disengaged by manually applying pressure radially inward, and then pulling the cap in an axial direction away from the vial.

6. The improvement of claim 5 in which the cap is reversible.

* * * * *